United States Patent [19]

Kessel

[11] Patent Number: 4,765,004

[45] Date of Patent: Aug. 23, 1988

[54] FOLDING PORTABLE CRIB

[75] Inventor: Jason H. Kessel, Sharon, Mass.

[73] Assignee: West End Hub Spring Company, Stoughton, Mass.

[21] Appl. No.: 872,698

[22] Filed: Jun. 10, 1986

[51] Int. Cl.[4] ..... A47C 29/00; A47C ; A47L 5/02

[52] U.S. Cl. ..... 5/93 R; 5/99 R; 5/99 C; 16/341; 16/382

[58] Field of Search ..... 5/99 C, 99 A, 99 B, 5/99 R, 93 R; 16/341, 337, 382, 383, D 40; 403/113, 117, 161, 91; 403/111, 120, 119

[56] References Cited

U.S. PATENT DOCUMENTS

| | | | |
|---|---|---|---|
| 437,598 | 9/1890 | Higgins | 403/113 |
| 600,647 | 3/1898 | Niemeyer | 5/57 R |
| 857,519 | 6/1907 | Foster | 403/119 X |
| 2,132,988 | 10/1938 | Leibo | 5/99 C X |
| 2,493,083 | 1/1950 | Pascoo | 5/99 C |
| 2,583,187 | 1/1952 | St. Clair Newbern | 5/99 C |
| 2,610,331 | 9/1952 | Kuniholm | 5/99 C |
| 2,659,903 | 11/1953 | Hagelfeldt | 5/99 C |
| 2,769,183 | 11/1956 | Froelich | 5/99 C |
| 2,825,071 | 3/1958 | Landry et al. | 5/99 R |
| 3,183,528 | 5/1965 | Jacobs et al. | 5/99 R |
| 3,296,633 | 1/1967 | Rieger | 5/99 R |
| 3,631,548 | 1/1972 | Dahab | 5/99 R |
| 3,654,645 | 4/1972 | Lee | 5/99 |
| 3,722,009 | 3/1973 | Hrynda | 5/93 |
| 3,789,439 | 2/1974 | Berg et al. | 5/99 C |
| 3,800,341 | 4/1974 | Davanzo | 5/99 R |
| 3,856,325 | 12/1974 | Willets | 403/120 X |
| 3,896,513 | 7/1975 | Boucher et al. | 5/99 R |
| 3,999,229 | 12/1976 | Wyss | 5/99 A |
| 4,069,524 | 1/1978 | Carlo | 5/99 B |
| 4,070,716 | 1/1978 | Satt et al. | 5/99 C |
| 4,097,942 | 7/1978 | Bridger | 5/93 B |
| 4,202,065 | 5/1980 | Sullivan | 5/99 C X |
| 4,218,809 | 8/1980 | Zimmermann | 403/117 |
| 4,286,353 | 9/1981 | Roche | 16/341 |
| 4,356,593 | 11/1982 | Heininger et al. | 16/251 |
| 4,357,735 | 11/1982 | Saint et al. | 5/99 B X |
| 4,483,026 | 11/1984 | Kassai | 5/99 B X |

FOREIGN PATENT DOCUMENTS

| | | | |
|---|---|---|---|
| 184889 | 3/1956 | Fed. Rep. of Germany | 403/161 |
| E8208VI | 6/1956 | Fed. Rep. of Germany | 403/113 |
| 3309186 | 4/1984 | Fed. Rep. of Germany | 403/119 |
| 323908 | 5/1970 | Sweden | 16/337 |
| 602703 | 6/1948 | United Kingdom | 5/99 R |
| 741157 | 11/1955 | United Kingdom | 403/161 |

*Primary Examiner*—Michael F. Trettel

*Attorney, Agent, or Firm*—Weingarten, Schurgin, Gagnebin & Hayes

[57] ABSTRACT

A collapsible infant's crib is provided with hinged sides which fold inwardly. The side hinges are constructed to be slightly non-linear when in the open position, to provide an inward bias which prevents undue flexing of the joint when the crib is in use. The crib is held in open position by a tightly fitting bottom which opposes the inward bias of the sides and holds them straight. The sides are attached to the end of the crib by means of brackets of unequal length such that the crib folds down very compactly.

5 Claims, 2 Drawing Sheets

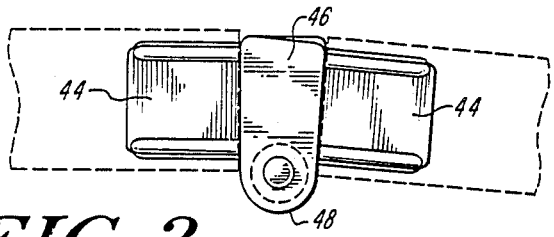
FIG. 2
FIG. 6
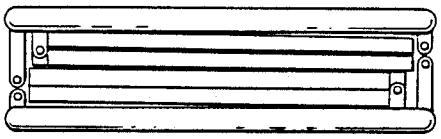
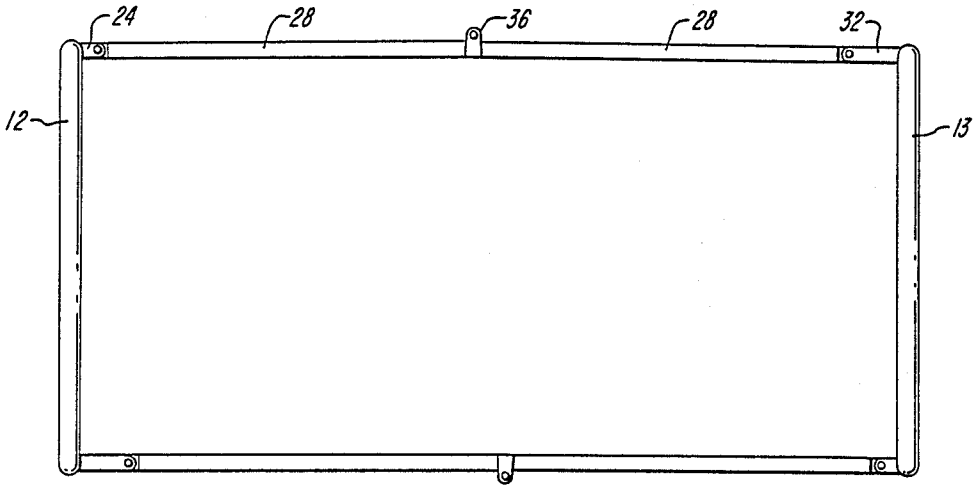
FIG. 4
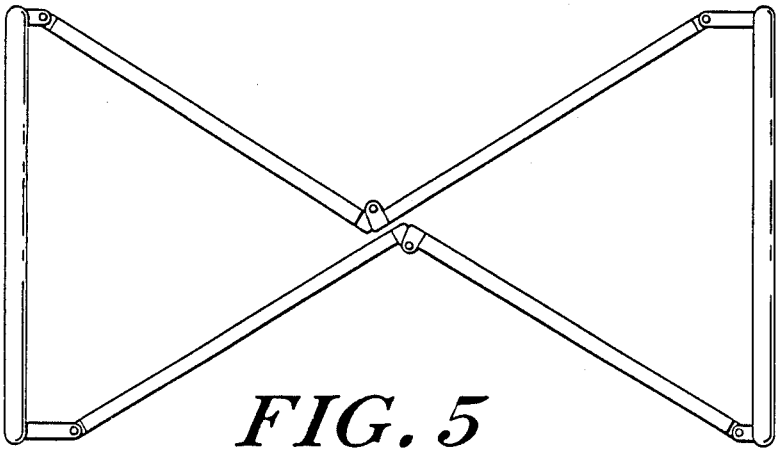
FIG. 5

FOLDING PORTABLE CRIB

FIELD OF THE INVENTION

This invention relates to folding beds, and in particular, to a sturdy crib which folds compactly into a self-supported easily stored unit.

BACKGROUND OF THE INVENTION

Children's cribs capable of being foded into a relatively compact configuration for ease of moving and for storage have been known for many years, and a variety of such cribs is available on the market place. A number of such cribs are shown in the U.S. Pat. Nos. 3,896,513 of Boucher; 3,722,009 of Hrynda; 3,654,645 of Lee; and 4,097,942 of Bridger. Some of such units are constructed for use as a combination crib and playpen, as illustrated by U.S. Pat. No. 3,800,341 of Davanzo. This unit has sides hinged such that upon folding, each side collapses into the end piece, which is constructed like one half of a suitcase, and the end pieces are then latched together to provide a self-contained suitcase-like unit. An earlier collapsible crib having essentially the same folding mechanism as the Davanzo unit is that shown in U.S. Pat. No. 3,631,548 of Dahab. In this unit, the side panels are provided with spring-loaded barrel bolts which lock the respective sides in the open position when the crib is in use.

Each of the presently available folding crib constructions suffers from certain deficiencies. Some are not designed to fold into an optimally small package. Others are rather heavy or cumbersome, while still others are rather flimsy. Some are unduly complex.

Cribs having hinged sides present the possibility of undue flexing at the joints, which can lead to instability of the crib as a whole. Furthermore, as the general shape of the crib is frequently defined and maintained by the crib bottom, if the sides or ends can bow out from the bottom sections, the possibility exists that a baby's hand or foot may become pinched between the side and the bottom, resulting in injury. The possibility of injury also exists where the side can bow inwardly, opening the butted ends of the side rails somewhat to create a small space therebetween which later closes up again when the side resumes its normal position.

Various mechanisms for reinforcing joints in foldable crib sides have been employed by the art. In the crib of Boucher, each folding end is provided with a gate lock 26. In the crib of Hrynda the sides are held in open position by a latch 34 secured by brackets 35. In the Lee crib the sides are locked in a straight position by slide locks in which a shaft in one side section fits into a socket in the other side section. Bridger employs a simple catch structure 45 to stabilize the joint in the sides of his crib. In the Davanzo crib, a rigid sleeve 26 over the hinge helps to prevent undue flexing of the sides at the hinge. Finally, in the crib of Dahab the foldable sides are held in open position by barrel bolts 37 which snap into locked positions when the crib is opened. In these barrel bolts, an elongated bullet-shaped member carried within one tubular side rail can slide forward to mate with an opposing tubular side rail, locking the two rails in a more or less linear configuration.

It is apparent that a deficiency of presently-available collapsible cribs is that it is difficult to construct or reinforce hinges that are sufficiently rigid to prevent undue flexing of the sides relative to the bottom of the crib, and to prevent inadvertent partial opening of the joint, both of which actions present the danger of injury to an infant. Accordingly, it would be very desirable to have available a folding crib constructed to fold into an optimally compact configuration, and yet having sturdy sides which do not flex objectionably either inwardly or outwardly.

SUMMARY OF THE INVENTION

The deficiencies of prior art crib constructions are overcome and the desired degree of rigidity in the sides of a folding crib having collapsible sides are provided in the present invention, which is a collapsible folding crib of very compact construction, which crib when open has sides which are hinged in a way which prevents undue flexing of the joint and reduces the possibility of infant injury.

The following crib of the invention possesses two opposing ends, each of which is bounded by sturdy vertical supports which serve as legs and framing members. The crib also has two opposing sides, each of which has upper and lower rails hinged at their mid-points with hinges constructed to permit the sides to fold inwardly. On each of the end sections, one of the vertical supporting members is provided with two short U-shaped brackets positioned and adapted to intersect in a hinge with one end of the side rails of one crib side. The second supporting member of each end unit is provided with U-shaped brackets longer than those provided on the first vertical supporting member, these longer brackets being positioned and adapted to connect in a hinge with one end of the side rails of the second crib side. Each crib side is attached at both ends of the side to vertical support members of the crib ends, by short U-shaped brackets at one end of the side, and at the other end of the side by long U-shaped brackets. As a result of this construction, the crib is able to fold very compactly. The crib is also provided with a bottom which fits snugly between the bottom side rails of the crib, and between the respective ends, to hold the crib in shape during use.

The hinges at the mid points of the side rails are constructed to permit the sides to fold inward, and are also configured to be non-linear when opened. Thus, the sides are biased inwardly because of the construction of the central hinges, and are only forced into a straight-line configuration by the outward bias of a tightly-fitting bottom. These central hinges are made up of two identical hinge members connected by a linking pin. Each of the hinge members has a base shaped for attachment to a side rail of the crib, the base also having a flat front surface, this front surface further possessing a horizontal block with a ramped front surface. This horizontal block covers no more than approximately one half of the vertical thickness of the base, and is attached to the front surface of the base at one side thereof. This leaves at least an undivided half of the flat front surface of the base exposed. The horizontal block extends laterally beyond the side edge of the base, and this lateral extension is provided with a vertically oriented hole sized to accept the linking pin of the hinge. When the two hinge pieces are linked together to form a complete hinge, the flat front surface of the base of one of the pieces confronts the ramped front surface of the horizontal block of the other pieces, and vice versa. As a result, the hinge in its open position is non-linear, thereby providing a mechanism by which the sides of the crib may be biased inwardly so that they tend not to bow out during use. In use, the sides are forced into a linear orientation by the tight-fitting bottom of the crib, which provides an outward bias force against the sides of the crib.

DESCRIPTION OF THE DRAWINGS

The invention will be more fully understood from the following description taken in conjunction with the drawing in which:

FIG. 2 is a top view of the hinge employed at the mid points of the side rails, shown in open position;

FIG. 4 is a top view of the crib, showing the location of various hinges and the respective lengths of the brackets which hold the crib sides;

FIG. 5 is a top view of the crib, shown partially folded;

FIG. 6 is a top view of the crib, shown fully folded.

DETAILED DESCRIPTION OF THE INVENTION

Figure 1:
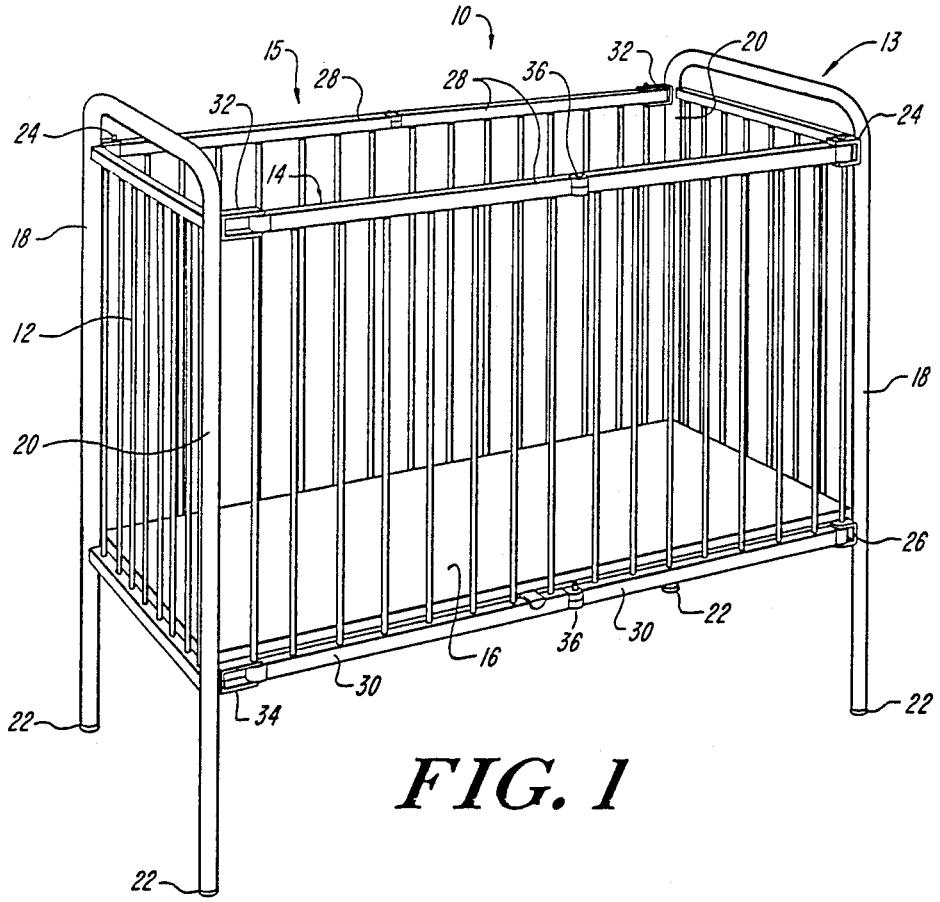
FIG. 1 is a perspective view of the crib of the invention.

Referring now to FIG. 1, there is shown a crib 10 in the usual rectangular form, having first and second opposing ends 12 and 13, and first and second opposing sides 14 and 15. The ends have equal horizontal lengths, and the sides are also of equal horizontal lengths, longer than the ends. The crib has a tight-fitting removable bottom 16, to support a crib mattress of the usual sort (not shown). The crib is normally made of tubular metal, though other materials may be employed.

Crib ends 12 and 13 are essentially identical and each is bounded by first and second upright members 18 and 20 respectively, these upright members terminating at their lower ends in feet 22. The feet may be configured in any of the ways known to the art, two non-limiting examples being simple convex terminating surfaces, and casters.

Sides 14 and 15 are hinged at their mid points by inwardly-bending hinges 36 to be discussed more fully below, each upper side rail being made up of two equal sections 28 and each lower side rail being made up of two corresponding equal sections 30.

First upright members 18 possess upper and lower short U-shaped brackets 24 and 26 respectively, located and adapted to meet and connect with the upper rail sections 28 and the lower rail sections 30, respectively, of the sides. The second upright members 20 possess upper and lower long U-shaped brackets 32 and 34 respectively, located and adapted to meet and connect with upper rail sections 28 and lower rail sections 30, respectively, of the sides. Each side is thus connected to one end of the crib via short U-shaped brackets 24 and 26, and to the other end of the crib via long U-shaped brackets 32 and 34, U-shaped brackets 24, 26, 32, and 34 serving as hinges.

Figure 3:
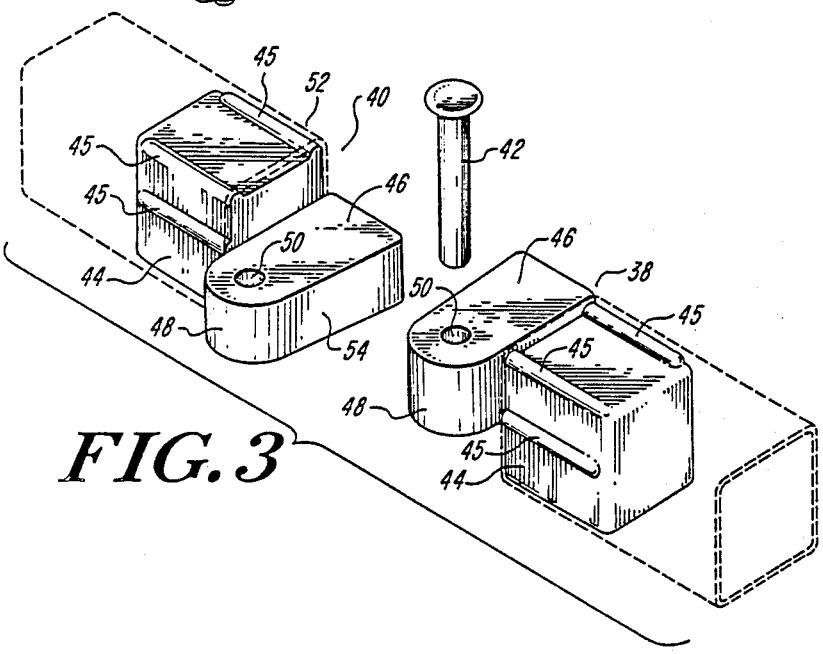
FIG. 3 is a perspective view of the mid-side hinge, shown disassembled.

FIGS. 2 and 3 show the inwardly-bending hinge 36 employed at the mid points of the upper and lower side rails. As shown in FIG. 3, hinge 36 is made of two identical hinge members 38 and 40 joined by a pin 42. These hinge members are preferably made of plastic, and can be integrally molded as a single piece simply and inexpensively. Such a manufacturing process has the additional advantage that the edges of the hinge members are smooth and not sharp, so do not catch an infant's clothes or fingers. Other materials may, however, be employed. Hinge members 38 and 40 each are provided with a base 44 for insertion into the top and bottom side rail sections 28 and 30. The top, bottom, and sides of base 44 are provided with horizontal ribs 45. In the assembled crib, each hinge member's base 44 is force fit into its respective side rail section, ribs 45 providing bearing support whereby the hinge member is retained in place in the side rail section. Other means for attaching the hinge members to the side rail sections can be envisaged. Located on the front surface of base 44 is a horizontal block 46 which extends laterally beyond the edge of base 44 on one side in a protrusion 48 which is sized to accept a vertical hole 50 for pin 42. Hole 50 is located such that its axis lies on the projection of the side of the side rail when mounted on the side rail, as shown in FIG. 2.

Block 46 occupies no more than one half of the front surface of base 44 on which it is located, leaving at least an undivided one half of that surface of base 44 exposed as a flat forward surface 52. Block 46 has a ramped forward surface 54 as shown in FIG. 3. When two hinge members 38 and 40 are joined by pin 42 to form a complete hinge 36, ramped forward surface 54 of each part meets flat forward surface 52 of the other part, resulting in side rail sections 28 and 30 respectively being joined by hinge 36 in a slightly non-linear fashion, as shown in FIG. 2.

Hinge 36 is installed in the side rails such that the sides fold inwards, thus requiring an outward bias on the side rails to force them straight. This biasing force is provided by the crib bottom 16, which is sized to fit snugly, so that the crib sides are held straight in use while the crib sides in turn hold the bottom 16 firmly to prevent movement and rattling of the crib.

FIGS. 4–6 show how the crib folds, and make it clear that the short U-shaped brackets 24 and 26 are approximately the same length as the thickness of the side rail sections 28 and 30, and that the long U-shaped brackets are approximately as long as three thicknesses of the side rail sections 28 and 30, for compact folding. FIGS. 4–6 also show that for most compact construction, ends 12 and 13 should have horizontal lengths approximately equal to the lengths of the side rail sections 28 and 30 plus a length corresponding to three or four times the thickness of these side rail sections.

While the invention has been explained with reference to a single embodiment, those skilled in the art will appreciate that certain modifications may be made without departing from the inventive concept. Accordingly, the scope of the invention is not to be limited except by the scope of the appended claims.

What is claimed is:

1. A folding crib, comprising:

two opposing crib ends, each crib end being bounded by a first and a second upright member;

two opposing sides, each of said sides being pivotally connected at each of its ends to an upright member of each of said opposing crib ends, each of said sides having an upper and a lower rail, each of said rails possessing a hinge at its midpoint, each of said hinges being constructed and installed in a respective side rail to bias said sides inwardly when the crib is in its open position, and to permit said sides to fold inwardly; and a bottom, sized to fit between said opposing crib ends and said opposing sides;

each of said hinges further comprising:

first and second hinge members made of a resilient material; and a linking pin; each of said hinge members further comprising:

a first hinge section constituting a base adapted for insertion into a hollow end of a confronting rail section, said first hinge section having a flat forward surface perpendicular to the longitudinal axis of said rail section when said first hinge section is incorporated into said rail section; and a second hinge section constituting a block projecting perpendicularly from said forward surface of said first hinge section, said second hinge section having:

(a) a flat bearing surface disposed substantially at the midplane of said forward surface of said first hinge section, (b) an extension beyond a side wall of said first hinge section, said extension having a hole sized to accommodate said linking pin and being disposed along an axis outward of said side wall, said hole being parallel to said side wall and perpendicular to said bearing surface, and terminating in said bearing surface, and (c) a ramped front surface perpendicular to said bearing surface and angled outwardly from said extension relative to said forward surface of said first hinge section;

said first and second hinge members being joined via said linking pin, which is inserted through the aligned holes of the respective second hinge sections, such that said bearing surfaces of the respective second hinge sections are in sliding engagement and said forward surfaces of the respective first hinge sections can contact said ramped front surfaces of the respective second hinge sections, resulting in a slightly non-linear junction in which the axes of said first hinge sections can be forced into linearity by application of a bias directed against the hinge from the side opposite said linking pin and perpendicular to it.

2. The crib of claim 1 wherein said ends and said sides are constructed of metal tubing.

3. The crib of claim 1 wherein the resilient material constituting said first and second hinge members is a plastic.

4. A hinge for forming a non-linear junction between the ends of two longitudinal members, comprising:

first and second hinge members made of a resilient material; and a linking pin;

each of said hinge members further comprising:

a first hinge section constituting a base adapted for insertion into a hollow end of a confronting longitudinal member, said first hinge section having a flat forward surface perpendicular to the longitudinal axis of said longitudinal member when said first hinge section is incorporated into said longitudinal member; and a second hinge section constituting a block projecting perpendicularly from said forward surface of said first hinge section, said second hinge section having:

(a) a flat bearing surface disposed substantially at the midplane of said forward surface of said first hinge section, (b) an extension beyond a side wall of said first hinge section, said extension having a hole sized to accommodate said linking pin and being disposed along an axis outward of said side wall, said hole being parallel to said side wall and perpendicular to said bearing surface, and terminating in said bearing surface, and (c) a ramped front surface perpendicular to said bearing surface and angled outwardly from said extension relative to said forward surface of said first hinge section;

said first and second hinge members being joined via said linking pin, which is inserted through the aligned holes of the respective second hinge sections, such that said bearing surfaces of the respective second hinge sections are in sliding engagement and said forward surfaces of the respective first hinge sections can contact said ramped front surfaces of the respective second hinge sections, resulting in a slightly non-linear junction in which the axes of said first hinge sections can be forced into linearity by application of a bias directed against the hinge from the side opposite said linking pin and perpendicular to it.

5. The hinge of claim 4 wherein the resilient material constituting said first and second hinge members is a plastic.

* * * * *